US005573251A

United States Patent [19]

Beard et al.

[11] Patent Number: 5,573,251

[45] Date of Patent: Nov. 12, 1996

[54] DART FLIGHT STEM

[75] Inventors: Eric Beard, Roydon; Gary Plummer, Harlow; Christopher Thorburn, Hoddesdon, all of Great Britain

[73] Assignee: Target Sports Limited, United Kingdom

[21] Appl. No.: 286,346

[22] Filed: Aug. 5, 1994

[30] Foreign Application Priority Data

May 4, 1994 [GB] United Kingdom ..... 9408845

[51] Int. Cl.[6] ..... A63B 65/02

[52] U.S. Cl. ..... 273/416; 29/517; 403/165

[58] Field of Search ..... 273/416, 419, 273/420, 423; 403/165, 320, 274; 411/301–304; 29/515–519, 102, 1.2

[56] References Cited

U.S. PATENT DOCUMENTS

| | | | |
|---|---|---|---|
| 392,062 | 10/1888 | Pedersen | 403/165 X |
| 2,583,474 | 1/1952 | Cozzone | 403/165 X |
| 4,353,280 | 10/1982 | Spercel | 29/517 X |
| 4,842,285 | 6/1989 | Farler | 273/423 X |

FOREIGN PATENT DOCUMENTS

| | | | |
|---|---|---|---|
| 1508075 | 4/1978 | United Kingdom | 273/423 |
| 1556807 | 11/1979 | United Kingdom | 273/416 |
| 2026332 | 2/1980 | United Kingdom | 273/416 |
| 2064967 | 6/1981 | United Kingdom | 273/423 |
| 2068755 | 8/1981 | United Kingdom | 273/416 |
| 2097267 | 11/1982 | United Kingdom | 273/416 |

*Primary Examiner*—Paul E. Shapiro
*Attorney, Agent, or Firm*—Clifford A. Poff

[57] ABSTRACT

A dart flight stem comprises a metal root portion attached by screw thread to a dart barrel. A flight-holding portion is mounted on the root portion for rotation about the longitudinal axis of the flight stem. A shaft extends axially from the flight-holding portion into a complementary bore extending axially from the adjoining end of the root portion. The shaft has a circumferential groove and the peripheral metal wall in the root portion is locally crimped to form radially inwardly peripheral projections in the circumferential groove around the shaft, whereby the flight holding portion is held captive on said root portion. The dart flight stem made by a method of selecting root portion with screw threads at the front end for attachment to a dart barrel. A flight holding portion is mounted on the rear end of the root portion. An axial blind bore is provided in the root portion to establish a rotating fit with a shaft on the flight holding portion. The shaft is provided with a circumferential groove and inserted into the bore following which crimping of the bore radially inwardly forms a projection in the groove to hold the flight portion captive on the root portion. The root portion is then turning down to remove exterior indentations.

4 Claims, 2 Drawing Sheets

DART FLIGHT STEM

THIS INVENTION relates to dart flight stems, more particularly to dart flight stems of the type in which a flight holding portion is rotatable with respect to a root portion adapted to be fixed to a dart barrel, whereby if it should happen, during play, that after the dart has been thrown into a dart-board, and a following dart thrown should strike the dart flight, the flight holding portion, with the flight, can rotate out of the way of the following dart to avoid damage to the flight.

It is an object of the invention to provide an improved dart flight stem of the above type.

In accordance with the invention there is provided a dart flight stem comprising a root portion adapted for attachment to a dart barrel and a flight-holding portion mounted on the root portion for rotation about the longitudinal axis of the flight stem, wherein the rotational mounting of said flight-holding portion on said root portion comprises a shaft extending axially from one said portion into a complementary bore extending axially from the adjoining end of the other said portion, said shaft having a circumferential groove and said bore being bounded by a peripheral metal wall of said other portion, said peripheral metal wall being locally crimped radially inwardly to form a projection or projections on the peripheral surface of said bore which projects or project into said circumferential groove, whereby the flight holding portion is held captive on said root portion.

Figure 1:
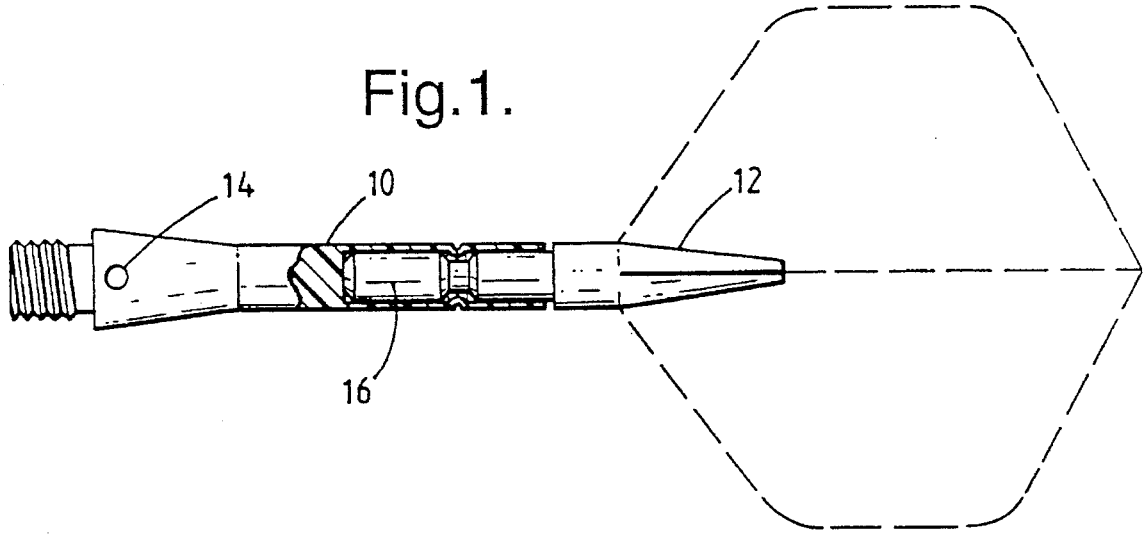
Figure 2:
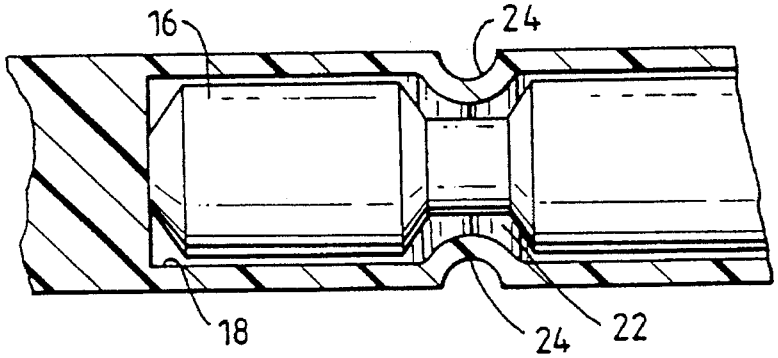
Figure 3:
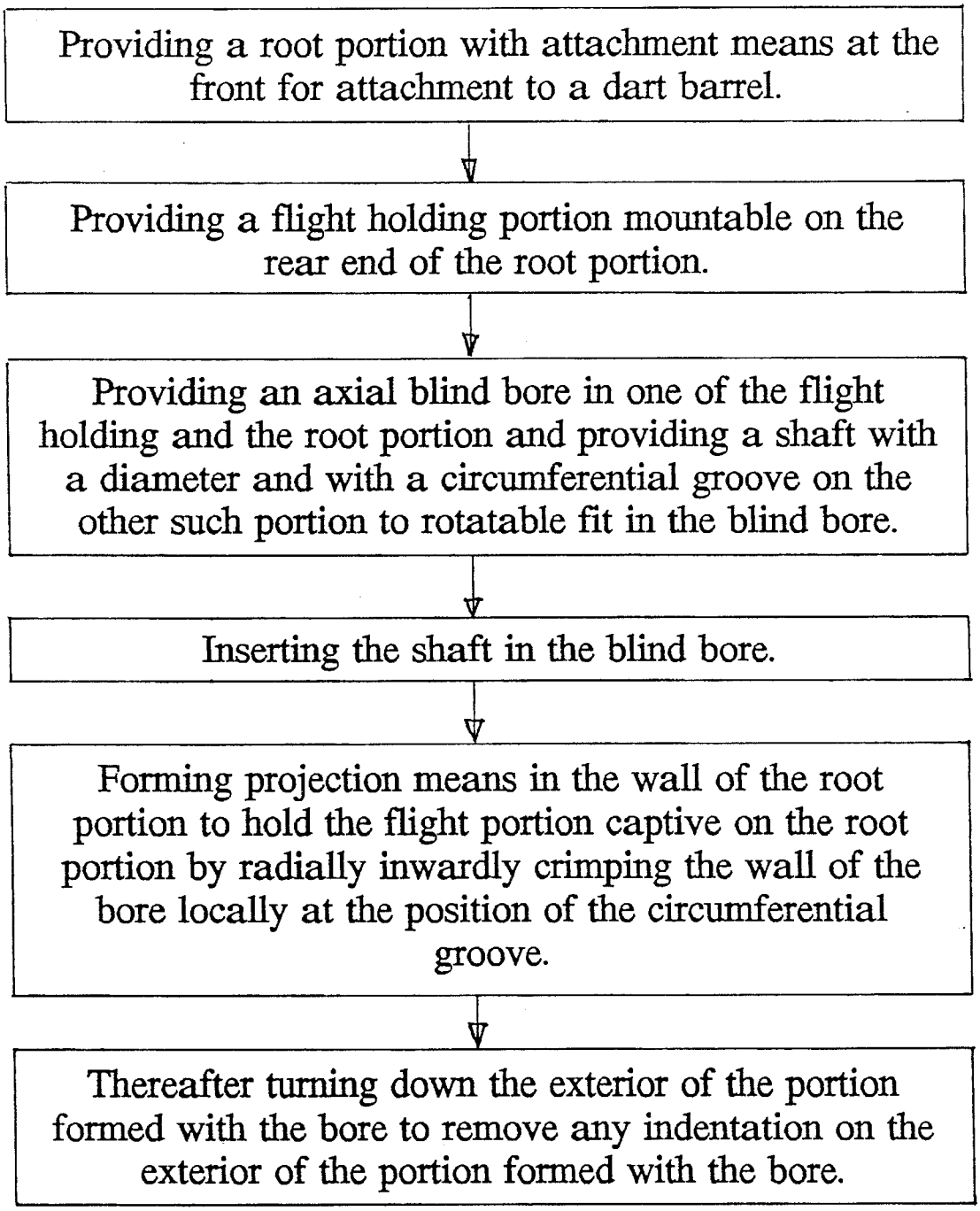

An embodiment of the invention is described below by way of example with reference to the accompanying drawings in which:

FIG. 1 is a side view, partly in axial section, of a dart flight stem embodying the invention, FIG. 2 is an enlarged view of a detail of FIG. 1 and FIG. 3 is a flow chart showing the method steps for carrying out the method of the present invention.

Referring to the drawings, a dart flight stem comprises two components, namely a root portion 10 and a flight holding portion 12. Both components have substantial rotational symmetry about the longitudinal axis of the stem.

The root portion 10 has, at a free end thereof, an externally screw-threaded stub for screwing into a complementarily screw-threaded bore in the rear end of a dart barrel in a manner known per se. A diametral bore 14 through the root portion 10 adjacent the screw-threaded portion allows insertion of the point of another dart to assist in screwing the root portion into the dart body.

A substantial part of the root portion 10 extending to the rear end thereof is substantially cylindrical externally and an axial blind bore 18 extends into the root portion 10 from the rear end of said root portion. The flight-holding portion 12 includes a rear part configured conventionally to hold a conventional dart flight of generally cruciform section comprising four thin flat vanes extending from an axial junction. Thus the rear part of flight holding portion 12, which tapers towards the rear end of the flight stem is formed with two mutually perpendicular, diametral, longitudinally extending slots to receive the dart flight removably and replaceably, in manner known per se. Such a dart flight stem is indicated in broken lines in FIG. 1 by way of illustration. The flight holding portion 12 includes a forward part in the form of a cylindrical shaft 16 which is a close sliding and rotating fit in the bore 18 (with the exception of the groove and crimping referred to below). The part of the flight holding portion immediately to the rear of the shaft 16, has an external diameter corresponding to that of the rear, cylindrical part of the root portion 10 and an annular shoulder extends between the last-mentioned rear part of portion 12 and the rear end of shaft 16. The forward end of shaft 16 is bevelled or chamfered as best shown in FIG. 2 to provide an abutment face of reduced diameter with respect to the major part of the shaft, which abutment face can cooperate with the end of the blind bore 18. The shaft 16 is slightly longer than the bore 18 so that a gap is maintained between the rear end of the root portion 10 and said annular shoulder on the flight holding portion 12. Accordingly, when the flight holding portion 12 is urged forwards, relative to the root portion, by, for example, a following dart striking the flight, the reduced diameter forward end of the shaft 16 and the cooperating end wall of the blind bore 18 form a relatively low-friction thrust bearing permitting easy rotation of the flight holding portion 12 and thus of the flight held therein.

The shaft 16 has, intermediate its ends, a circumferential groove 22. In manufacture of the flight stem, the bore 18 is initially of uniform diameter throughout its length so that the shaft 16 can be inserted fully into the bore 18. The wall of the rear part of the root portion 10 is then crimped. i.e. deformed radially inwardly, locally, at the axial position of the groove 22, as indicated at 24. The extent of the inward deformation is exaggerated in FIG. 2 but is sufficient to intrude the material of the bore wall slightly into groove 22 and thereby prevent subsequent axial withdrawal of the shaft 16 from the bore 18. The axial extent of the crimping or deformation 24 is less than that of the groove 22 so that the shaft 16 remains free to rotate in the bore 18. The portions 10, 12 of the flight stem are preferably formed from malleable metal, such as aluminium alloy, which allows the shaft 16 and bore 18 to be formed to close tolerances and allows the crimping of the wall of the bore 18 as described. If desired, the rear part of the root portion 10 may be initially made of a diameter greater than the finished diameter, at least in the locality of the eventual crimping 24 and the rear part of portion 10 may be turned down after such crimping to provide a smooth uniform outer surface bearing no evidence of the crimping.

As can be seen from FIG. 3, the steps for carrying out the method of the present invention are shown. As described previously, the dart flight stem comprises a root portion 10 and a flight holding portion 12. In the step identified by as reference numeral 30, the root portion is provided with attachment means, the screw-threaded stub at the front thereof for attachment to a dart barrel. In the next step, identified by reference numeral 32, the flight holding portion 12 is provided with a cylindrical shaft 16 mountable on the rear end of the root portion. This is furthered by providing, according to step 34, an axial blind bore 18 in one of the flight holding and the root portion and providing the shaft 16 with a diameter and with a circumferential groove 22 on the other such portion to rotatable fit in the blind bore. According to the step identified by reference numeral 36 the shaft is inserted in the blind bore. Thereafter, according to the step identified by reference numeral 38, projection means 24 is formed in the wall of the root portion to hold the flight portion captive on the root portion by radially inwardly crimping the wall of the bore locally at the position of the circumferential grove. Thereafter, according to the step identified by reference numeral 40, a turning down the exterior of the portion formed with the bore is carried out to remove any indentation on the exterior of the portion formed with the bore.

We claim:

1. A dart flight stem comprising a root portion adapted for attachment to a dart barrel and a flight-holding portion mounted on the root portion for rotation about the longitudinal axis of the flight stem, wherein the rotational mounting of said flight-holding portion on said root portion comprises a shaft extending axially from one said portion into a complementary bore extending axially from the adjoining end of the other said portion, said shaft being slightly longer than said bore and said bore having an end face, said shaft having a free end for cooperation with said end face to form a thrust bearing, so that movement of said flight holding portion forwards relative to said root portion, and thus towards the dart barrel, is limited by engagement of said free end of said shaft with said end face of said bore, said shaft having a circumferential groove and said bore being bounded by a peripheral metal wall of said other portion, said peripheral metal wall being locally crimped radially inwardly to form projection means on the peripheral surface of said bore which projects into said circumferential groove, whereby the flight holding portion is held captive on said root portion.

2. A dart flight stem according to claim 1 wherein said peripheral metal wall is of aluminum alloy.

3. The dart flight stem of claim 1 wherein said shaft is provided at a front end of said flight holding portion and said bore is provided extending from a rear end of said root portion.

4. A method of making a dart flight stem, comprising providing a root portion having attachment means at a front end for attachment to a dart barrel, providing a flight-holding portion mountable at the rear end of said root portion, providing an axial blind bore extending into one said portion and providing a shaft on the other said portion, said shaft being of a diameter to be a rotating fit within said bore, providing a circumferential groove around said shaft, inserting said shaft into said bore and crimping the wall of said bore radially inwardly locally at the position of said groove to form projection means in the wall of said bore, to hold the flight portion captive on said root portion and thereafter turning down the exterior of the portion formed with said bore to remove any indentation on the exterior of said portion formed with said bore.

* * * * *